US007264003B2

(12) United States Patent
Chayeb

(10) Patent No.: US 7,264,003 B2
(45) Date of Patent: Sep. 4, 2007

(54) HAIR STYLING ACCESSORY

(76) Inventor: Yoreila A. Chayeb, P.O. Box 141522, Coral Gables, FL (US) 33114

( * ) Notice: Subject to any disclaimer, the term of this patent is extended or adjusted under 35 U.S.C. 154(b) by 190 days.

(21) Appl. No.: 11/249,306

(22) Filed: Oct. 14, 2005

(65) Prior Publication Data

US 2007/0084477 A1 Apr. 19, 2007

(51) Int. Cl.
*A41G 5/00* (2006.01)

(52) U.S. Cl. ..... 132/54

(58) Field of Classification Search ..... 132/53, 132/54, 55, 105, 107, 130, 274, 101, 60
See application file for complete search history.

(56) References Cited

U.S. PATENT DOCUMENTS 3,385,305 A * 5/1968 Buzzelli ..... 132/105
3,419,020 A * 12/1968 Courtney ..... 132/54
3,557,806 A * 1/1971 Blanchard ..... 132/101
4,625,739 A * 12/1986 Hamazaki ..... 132/54
5,765,571 A * 6/1998 Dinnel ..... 132/210

* cited by examiner

*Primary Examiner*—Todd E. Manahan
(74) *Attorney, Agent, or Firm*—John H. Faro

(57) ABSTRACT

A hair dressing foundation having an essentially oval convex shell-like element and an array of comb-like teeth radiating from the edges thereof. The convex shell-like element of this foundation includes an essentially resilient non-porous body that is suitable for use in hair dressing, specifically, un "up-do" hair style. The foundation can be essentially colorless or, alternatively, color-keyed to the customer's hair.

5 Claims, 2 Drawing Sheets

HAIR STYLING ACCESSORY

BACKGROUND OF THE INVENTION

1. Field of the Invention

This invention relates to an article of manufacture. More specifically, this invention is directed to a hair dressing foundation for use in styling hair.

2. Description of Prior Art

The adaptation of various accessories as foundations for hair styling, for both men and women, is well-known.

U.S. Pat. No. 5,756,571 (to Dinnel, issued Jun. 16, 1998) discloses a hair dressing foundation for use in the styling of a French twist hairstyle. In the Dinnel discussion of the prior art, Dinnel also discloses a relatively comprehensive survey of the prior art, which is herein incorporated by reference in its entirety. In the prior art discussed by Dinnel, a number of devices have been conceived which are suitable in a variety of different hairstyles. In general these devices fall within basically two distinct categories: devices: (a) devices in which the hair is wrapped around the device, and, alternatively, (b) devices in which the hair is integrated within the device, e.g. pulled through one or more of passages formed within the device.

The Dinnel concept is representative of this prior category of product. In Dinnel, he uses an essentially planar, essentially rectangular, component having comb-like teeth extending on each of the two opposing long dimensions thereof. In use of the Dinnel device, the hair stylists simply wraps the customer's hair around the device in preparation of a French twist. The comb-like teeth of the device retain the hair on the device within the twist and, thus, the twist does not become undone.

U.S. Pat No. 3,452,761 (to Siegel, issue May 11, 1967) is representative of the second category of hair foundation product, specifically, a foundation in which the hair is integrated within the device, (e.g. pulled through and over the foundation), to provide an elevated hairstyle with a minimum of teasing of the hair. In brief, the Siegel device comprises a dome-like scaffold having an open and resilient architecture. In use, the Siegel device is place at the crown on or near the top of the customer's head; and, the hair from below the device drawn through and over the device by the stylist. In the preferred embodiments of the Siegel device, a series or array of comb-like teeth are also provided on each of the two opposing lateral margins of his device to assist in the placement of the device on the crown of the customer's head. According to Siegel, his device is positioned in place by first compressing the dome-like scaffold along each of its lateral margins, placement of the device in the appropriate location on the customer's head, and thereafter releasing the pressure on the device so as to permit the comb-like teeth, on either side of the device, to anchor the device within the customer's hair on either side of the device.

As is evident from the foregoing discussion, hair dressing foundations, which commonly utilized in hairstyling, are both numerous and unnecessarily complicated. It does, however, appear that up to now there is no acceptable foundation available to the hairstylist for elevating a hairstyle without either teasing the customer's hair, or by drawing the customer's hair through a scaffold-like device. This latter requirement is apparently dictated by the fact that without adequate attachment of the foundation to the customer's head, the hairstylist cannot insure that the hair will remain in place on hair dressing foundation.

Accordingly, there continues to exist a need to provide a hair styling foundation which can both provide hair dressing foundation for an elevated (lift) hair style, and yet remains in place without either teasing the customer' hair or enmeshing the customer's hair within the hair dressing foundation.

OBJECTS OF THE INVENTION

It is the object of the invention to remedy the above as well as related deficiencies in the prior art.

It is another object of this invention to provide a hair dressing foundation having a closed, dome-like architecture and means for integration thereof within a hairstyle so as to remain in position within the hairstyle.

It is yet another object of this invention to provide a hair dressing foundation having a closed, dome-like architecture and comb-like teeth radiating from each of the lateral margins thereof and from at least the leading and/or trailing margin thereof.

Additional objects of this invention include a hair styling method utilizing the hair dressing foundation of this invention.

SUMMARY OF THE INVENTION

The above and related objects are achieved by providing a hair dressing foundation for using in hair styling, specifically, hair styling woman's hair to achieve an "up-do" by elevating the height of the hair do to without back combing or teasing of the customer's hair. The hair dressing foundation of this invention is composed of a resilient material having an essential oval crown/convex shell with comb-like teeth projection from at least each lateral side thereof and one end thereof. In practice this foundation is composed of a resilient, sheet of inert plastic material (e.g. polyethylene) that can be readily flexed/compressed, so as to retract the comb-like teeth prior to placement upon the customer's head. Upon positioning of the foundation on the head of the individual, the foundation is then allowed to return to its original position, so as to cause the comb-like teeth to become engaged within the customer's hair on at least two, and preferably, at least three sides thereof. In one of the preferred embodiments of this invention, the surface of the convex shell foundation is modified, or covered with a material, to reduce the tendency of the hair slide over the foundation surface. In another of the preferred embodiments of this invention, the surface of the convex shell foundation includes a barrette-like accessory for retaining the hair upon the surface of the convex shell foundation.

Upon such placement and engagement of the foundation with hair of the individual, the foundation becomes relatively firmly anchored in position, and the hair stylist can then comb the customer's hair over and around the foundation, thereby producing lift to the hairdo without teasing and without potentially entangling the customer's hair with the body of the foundation.

DETAILED DESCRIPTION OF THE INVENTION INCLUDING PREFERRED EMBODIMENTS

Figure 1:
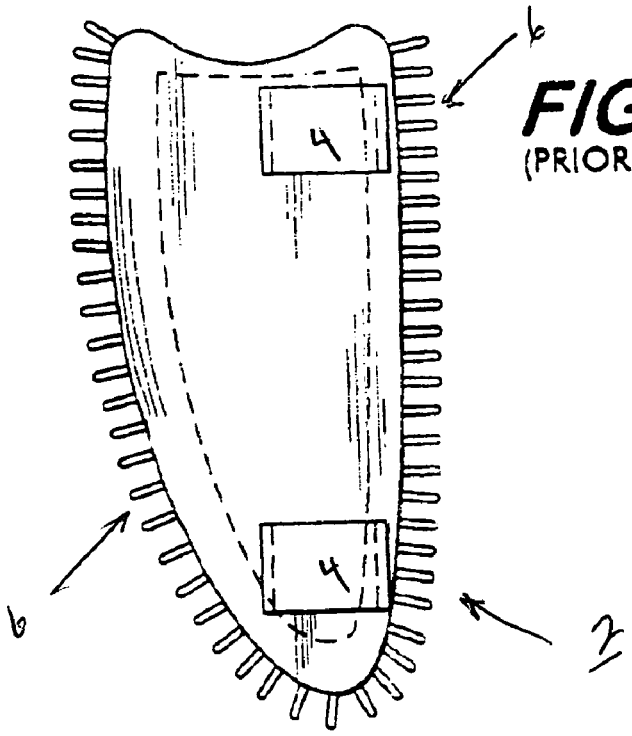
FIG.1 (PRIOR ART)
FIG. 1 is a perspective view of the prior art device disclosed in U.S. Pat. No. 5,756,571 (to Dinnel.

The drawings, which accompany this description, illustrate one or more features and/or embodiments of this invention. Where an element is common to more than one of these drawings, it is assigned a common reference numeral for ease of understanding and economy of expression.

Figure 2:
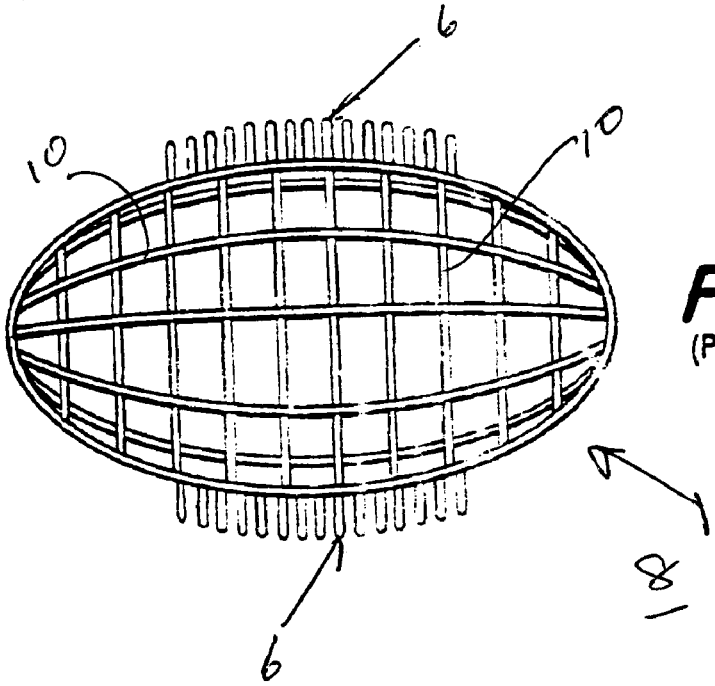
FIG.2 (PRIOR ART)
FIG. 2 is a perspective view of the prior art device disclosed in U.S. Pat. No. 3,452,761 (to Siegel.

FIGS. 1 & 2 illustrate prior art hair dressing foundations which include both a body and radiating comb-like teeth projecting from a foundation body. In the device depicted in FIG. 1, the Dinnel hair dressing foundation (2) is designed for use in the hair styling of a French twist. Accordingly, the use of the Dinnel hair dressing foundation requires that it be securely positioned and remain in place in an essentially vertical orientation, so as to retain the desired hair French twist hair style during the day to day activities of the customer. This is accomplished through a combination of tabs (4), and an array of lateral comb-like teeth (6) associated with such foundation. The tabs are used to secure the foundation to the head of the customer with bobby pins (not shown), and the comb-like teeth for engagement of the customer's hair along the long dimension of the hair dressing foundation.

In the device depicted in FIG. 2, the hair dressing foundation comprises a dome-like scaffold (8) of resilient material. Not unlike Dinnel, the Siegel hair dressing foundation also includes an array of comb-like teeth (6) radiating from each of the lateral margins thereof. These comb-like teeth (6) are used in the initial positioning of the Siegel hair dressing foundation upon the customer's head. Thereafter, the hair stylist pulls the customer's hair form under the dome-like scaffold (8), and integrates this hair from under the dome-like scaffold (8) with the ribs (10) that define this dome so as to produce an elevated hair style without back combing or teasing of the hair. While Siegel hair dressing foundation provides both adequate lift and integration into the hair style, the removal thereof can present problems where the hair becomes entangled within the ribs (10) dome-like scaffold (8).

Figure 3:
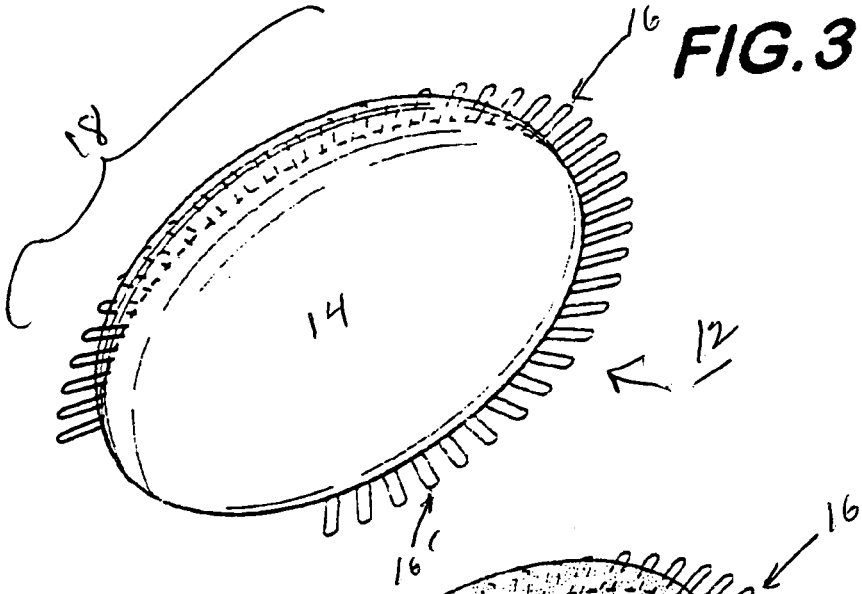
FIG. 3 is a perspective view of the hair styling foundation of this invention.

By way of contrast, FIG. 3 depicts an improved hair dressing foundation (12) of this invention in which an essentially oval, convex shell-like body (14) composed of sheet of inert material. This foundation (12) is provided with an array of comb-like teeth (16, 16') on at least three of the radial dimensions thereof. These comb-like teeth are preferably present on two of the opposing radial dimensions thereof corresponding to sides of an individual's head. In addition, the hair dressing foundation of this invention includes at least one addition array of comb-like teeth along the forward radial dimension (18) of the foundation. As in the Siegel device, the hair dressing foundation of this invention is flexible, and in use, can thus be initially compressed, placed by stylist upon the crown of the customer's head, and the compression release to engage the comb-like (16, 16') with the customer's hair on three sides of the device. Once, the hair dressing foundation is positioned as desired, the hair stylist can lift the hair forward and either side of the foundation, over the foundation, and thereby integrated the foundation with the customer's hair with ensnarling the hair with the foundation.

Figure 4:
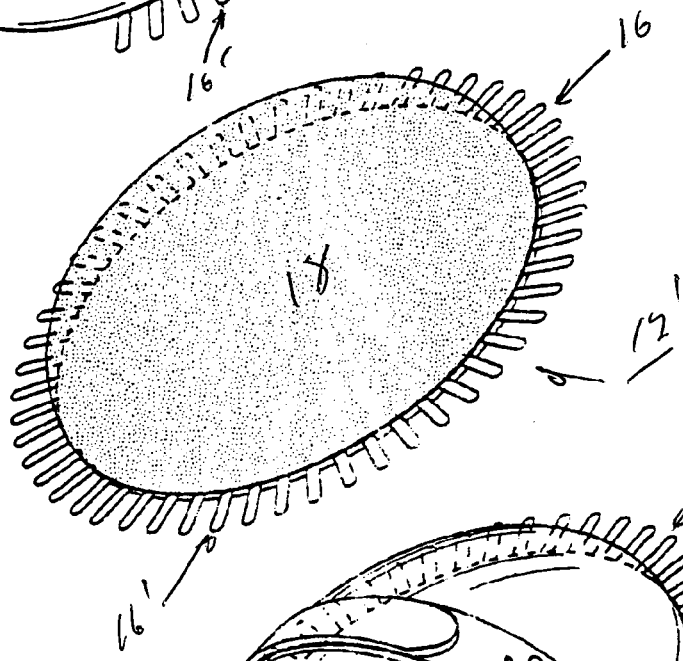
FIG. 4 is a perspective view of the hair stylist placement of the hair styling foundation of this invention upon a customer's head.

In another of the preferred embodiments of this invention, depicted in FIG. 4, the hair dressing foundation includes and array of comb-like teeth (16, 16') on each of the lateral radial dimensions, and on both the forward and trailing radial dimensions of the device. Also included in the device of FIG. 4, is a surface modification (18) thereto, in the nature of covering or coating, to proved texture to the surface of the foundation, and thereby increase the retention of the hair upon such modified surface.

Figure 5:
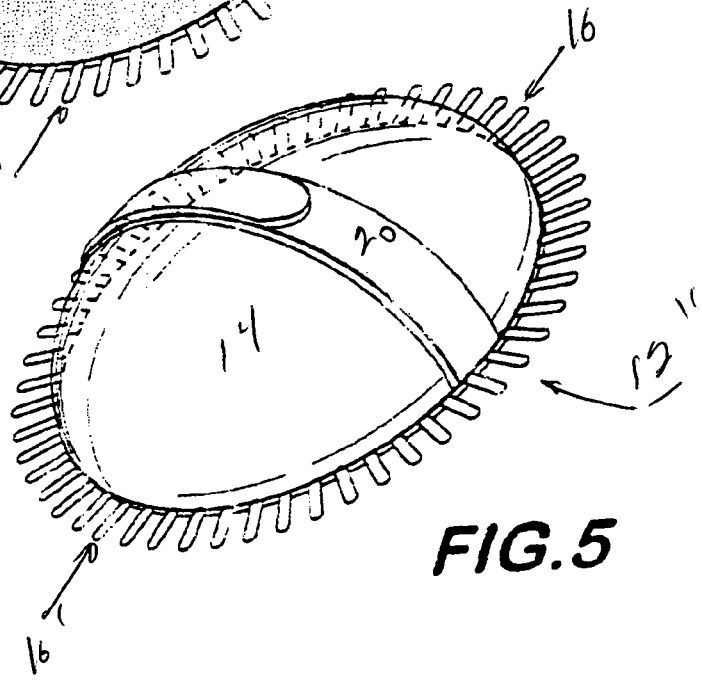
FIG. 5 is a perspective view of the hair stylist incorporation of the hair styling foundation of this invention with a customer's hair.

In another of the preferred embodiments of this invention, depicted in FIG. 5, the hair dressing foundation includes a barrette-like fastener (20) extending over the crown of the convex shell-like body (14) thereof. Thus, in the initial placement of the hair upon dressing foundation, the customer's hair is placed over the foundation and barrette (20) closed so as to releasably engage the foundation (12) and the customer's hair.

The foregoing Figures and accompanying description have been provided as illustrative of a number of the preferred embodiments of this invention, and not intended to delineate the scope thereof, which is set forth in the claims that follow.

What is claimed is:

1. A hair dressing foundation consisting essentially of an oval body having

A. a convex shell element of resilient material having a leading edge, a trailing edge and an opposing pair of lateral edges; and B. an array of comb teeth projecting from each of said opposing pair of lateral edges of said convex shell-like element and an array of comb-like teeth projecting from said leading edge of said convex shell-like element, with the proviso that said convex shell-like element comprises an essentially non-porous sheet of chemically inert plastic.

2. The hair dressing foundation of claim 1, wherein said said convex shell-like element also has an array of comb-like teeth on the trailing edge thereof.

3. The hair dressing foundation of claim 1, wherein the hair dressing foundation is essentially colorless.

4. The hair dressing foundation of claim 1, wherein the hair dressing foundation is color-keyed to match the customer's hair color.

5. The hair dressing foundation of claim 1, wherein the hair dressing foundation includes a barrette physically associated with said convex shell-like element.

* * * * *